US009850180B1

(12) United States Patent
Stepanov et al.

(10) Patent No.: US 9,850,180 B1
(45) Date of Patent: Dec. 26, 2017

(54) METHOD FOR MANUFACTURE OF AMORPHOUS ENERGETICS

(71) Applicants: Victor Stepanov, Highland Park, NJ (US); Rajen B. Patel, Parsippany, NJ (US); Alexander J. Paraskos, Sparta, NJ (US); Hongwei Qiu, Harrison, NJ (US)

(72) Inventors: Victor Stepanov, Highland Park, NJ (US); Rajen B. Patel, Parsippany, NJ (US); Alexander J. Paraskos, Sparta, NJ (US); Hongwei Qiu, Harrison, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 427 days.

(21) Appl. No.: 14/620,621

(22) Filed: Feb. 12, 2015

(51) Int. Cl.
*C06B 21/00* (2006.01)

(52) U.S. Cl.
CPC ..... *C06B 21/0033* (2013.01); *C06B 21/0025* (2013.01); *C06B 21/0091* (2013.01)

(58) Field of Classification Search
CPC ..... C06B 21/0016; C06B 21/0025; C06B 21/0041; G01N 23/00; G06F 9/30
See application file for complete search history.

(56) References Cited

U.S. PATENT DOCUMENTS 4,163,681 A * 8/1979 Rothenstein ..... C06B 23/005 149/11
5,547,527 A * 8/1996 Muller ..... C06B 21/0033 149/11
6,224,099 B1 * 5/2001 Nielson ..... C06B 21/0075 102/205
8,936,689 B1 * 1/2015 Stepanov ..... C06B 21/0008 149/109.6
9,073,800 B1 * 7/2015 Stepanov ..... C06B 45/22
9,212,102 B1 * 12/2015 Anderson ..... C06B 45/32
9,573,858 B1 * 2/2017 Brothers ..... C06B 47/10
2005/0189049 A1 * 9/2005 Ohno ..... C06B 47/145 149/2
2014/0034197 A1 * 2/2014 Sippel ..... C06B 45/18 149/3

OTHER PUBLICATIONS

Wang, Yi, et al., "Synthesis, thermolysis, and sensitivities of HMX/NC energetic nanocomposites". Journal of Hazardous Materials 312 (2016) 73-83.*
Nair, U.R., et al., "Hexanitrohexaazaisowurtzitane (CL-20) and CL-20-Based Formulations (Review)". Combustion, Explosion, and Shock Waves, vol. 41, No. 2, pp. 121-132, 2005.*
An, Chongwei, et al., "Nano-CL-20/HMX Cocrystal Explosive for Significantly Reduced Mechanical Sensitivity". Journal of Nanomaterials, vol. 2017, Article ID 3791320, pp. 1-7.*
Shklovskii, V.A., et al., "Explosive crystallization of amorphous substances". Sov. Phys. Usp. 32 (2), Feb. 1989, pp. 163-180.*
Bunte, Gudrun, et al., "Gas phase detection of explosives such as 2,4,6-trinitrotoluene by molecularly imprinted polymers". Analytica Chimica Acta 591 (2007) 49-56.*
Cooper, Paul W. and Kurowski, Stanley R. Introduction to the Technology of Explosives, 1996, p. viii-ix, Wiley-VCH, USA.
Meyer, R. et al., "Explosives", 6th Ed. Wiley-VCH, 2007, USA.
https://www.britannica.com/science/polyvinyl-acetate (last access Aug. 14, 2019).
Newman, Anne, Pharmaceutical Amorphous Solid Dispersions, Wiley, 2015, USA.

* cited by examiner

*Primary Examiner* — Bret Chen
(74) *Attorney, Agent, or Firm* — Lisa H. Wang

(57) ABSTRACT

A method for the manufacture of stable amorphous secondary explosives and combinations thereof—wherein the stability is enhanced with the addition of a polymeric additives and can be further enhanced with mechanical compression of the amorphous material.

5 Claims, No Drawings

METHOD FOR MANUFACTURE OF AMORPHOUS ENERGETICS

GOVERNMENTAL INTEREST

The invention described herein may be manufactured and used by, or for the Government of the United States for governmental purposes without the payment of any royalties thereon.

FIELD OF THE INVENTION

The present invention relates in general to the preparation of stable amorphous forms of secondary explosives and more particularly to a method of preparation of such materials using spray drying technology with the addition of polymeric additives and mechanical treatment.

BACKGROUND OF THE INVENTION

Secondary high explosives, including the nitramines RDX, HMX, and CL-20, are typically used in their common crystalline states. In order to alter their explosive properties including energetic performance and sensitivity to inadvertent initiation, parameters including the crystal size, crystal polymorph, and crystal quality are often varied.

A known alternative to the solid crystalline form of organic materials is an amorphous (aka glassy) state. A key distinction between these two forms/states, is that in the glassy state the constituent molecules are arranged in a highly disordered manner, while in crystalline materials the molecules have long range ordering. Due to the disorder in the molecular arrangement, amorphous materials inherently contain additional specific energy versus crystalline forms—as a result of the strained arrangement of the molecules. In such a "strained" form, materials typically exhibit drastically differing physical properties when compared to the crystalline form. These different physical properties are often characterized by: significantly lower thermal conductivity; optical transparency; and liquid-like viscous flow above the glass transition temperature (Tg). Further, due to the stored strain energy in the amorphous material, reaction of such materials can potentially be faster and more exothermic than in the crystalline form. So, while it would appear that amorphous materials have some potential advantages over crystalline materials for use as explosives—due to the higher Gibbs free energy inherent to the amorphous state relative to the crystalline state, there is a general tendency of amorphous materials to crystallize. This is a major obstacle encountered in numerous fields including pharmaceuticals and often hinders transitioning of amorphous materials to end items.

Therefore, there is a need in the art for secondary explosive materials that are in an amorphous state that is stable—such that the subject explosive materials will exhibit desirable properties not available in such materials that are in their crystalline forms.

SUMMARY OF THE INVENTION

The present invention addresses the forgoing concern by providing a method to obtain stable, novel, amorphous explosive materials which are prepared from conventional, crystalline, secondary high explosives, such as HMX and CL-20. In the subject novel amorphous form, the material properties drastically differ from the crystalline precursor materials. These properties include enhanced reactivity, reduced sensitivity to inadvertent initiation, ability to glass cast, and optical transparency. Surprisingly, the properties of the new amorphous high explosive materials enable the creation of explosive compositions which can be exceptionally insensitive, fully dense (>99% of theoretical maximum density (TMD)), and made readily detonable when desired upon heating; whereby the explosive material converts back to the crystalline form. Methodology is disclosed to obtain a highly amorphous product. Furthermore, methodology for stabilization of the amorphous material is provided. This is essential for successful implementation of amorphous explosive compositions as amorphous materials are known to have a high tendency to convert to the more thermodynamically favorable crystalline form.

To overcome the known tendency of amorphous explosive materials to convert to the more thermodynamically favorable crystalline forms—the amorphous powdered explosive materials of the subject invention are manufactured by a method which involves the rapid evaporative precipitation of the powder constituents from a solvent using conventional spray drying technology. A polymeric additive is required to prevent crystallization of the conventional, crystalline, secondary high explosive, or blends thereof, during the spray drying and to improve long term stability of the amorphous phase. Choice of a particular polymeric additive depends on the desired performance and stability of the end product.

Further, to enhance the stability of the amorphous material after the spray drying process, the subject inventive method involves compacting the amorphous spray dried material into a pellet, or other form. Such compaction greatly enhances the stability of the resulting amorphous material.

Additional features and advantages of the present invention will be set forth in, or are apparent from, the drawings and detailed description of preferred embodiments thereof which follows.

DETAILED DESCRIPTION OF PREFERRED EMBODIMENTS

New Materials, Properties, Applications

The amorphous secondary high explosive materials prepared by the present inventive method are readily used in current military munitions as replacements for the munitions main charges, boosters, and detonator output charges. As stated above, the subject amorphous explosive materials offer significant improvements in safety (sensitivity to inadvertent initiation) as well as explosive performance versus the commonly used crystalline explosives from which these materials are derived.

As also stated above, the amorphous materials which are the subject of this invention are prepared from at least one commonly used crystalline secondary high explosive materials, such as HMX, RDX, or CL-20. More specifically, the commonly used crystalline secondary high explosive material from which the inventive amorphous material are manufactured—can be a pure secondary high explosive material (such as HMX, RDX, or CL-20), or blends of two or more such crystalline secondary high explosive materials. The pure or blended crystalline secondary high explosive material must itself be blended with a polymeric additive to—as stated above, prevent crystallization of the conventional, crystalline, secondary high explosive, or blends thereof, during the spray drying and to improve long term stability of the resulting amorphous phase. The chemical structure, molecular weight, density or other relevant characteristic of the polymeric additive is important to obtain the desired stability and reactivity of the end product.

Further, as also stated above, due to the disordered arrangement of molecules in an amorphous state of the present inventive amorphous secondary high explosive materials—excess stored energy from configurational strain is present. This excess stored energy renders the material more reactive in relation to crystalline analogs. The enhanced reactivity and higher specific free energy of the amorphous material both are manifested in improved detonation and initiation behavior. This includes smaller critical detonation failure dimensions, improved corner turning, shorter shock to detonation transition (SDT) and shorter deflagration to detonation transition (DDT). These properties are especially important in explosive components with small charge dimensions. Another benefit of amorphous energetics of the present invention is enhanced burn rate which can be exploited in propellant applications ranging from rocket motors to microthrusters.

While the amorphous explosives of the present invention are more reactive and more energetic than the crystalline secondary explosive or explosives from which they are formed—importantly their initiation sensitivity can be surprisingly very low. The shock sensitivity, for example, can be effectively eliminated all together when the material is loaded at full density, with effectively no porosity. In such an instance, a highly homogeneous explosive charge is achieved, devoid of heterogeneities such as cracks, voids, and even grain boundaries and dislocations which are all characteristically present in crystalline charges and to which initiation sensitivity is attributed.

An important embodiment of the present invention is the capability of the highly insensitive amorphous phase to become sensitized on demand by heating, such that the material undergoes crystallization resulting in a heterogeneous, porous structure which can be readily initiated by existing initiation technology.

Also, improved loading of amorphous explosive is another advantage over traditional, crystalline forms thereof. This is a direct result of the glass transition phenomenon common to amorphous materials in general. Above the glass transition temperature (Tg), softening occurs such that the material exhibits liquid-like viscous flow—in which state, molding of amorphous explosives into casings can be accomplished at much lower pressures than when molding the conventional crystalline analogs. Further, and surprisingly, densities as high as ca. 100% of TMD are readily achievable.

Inventive Method

The inventive method for creating the amorphous energetic/secondary explosive materials of the present invention is based on the rapid precipitation of a crystalline secondary explosive material from solution. At very high precipitation rates, the conditions become favorable for the formation of the desired amorphous phase of the subject secondary explosive materials. The capacity to form an amorphous phase depends on the molecular structure including size and conformational flexibility of the particular crystalline explosive material being converted. In general, smaller molecules tend to be less likely to form an amorphous phase than larger molecules. Another factor is the melting point. Materials with lower melting points can be rendered amorphous by rapid melt quenching. Common secondary high explosive materials tend to have relatively small molecular sizes and therefore are more challenging to convert to the desired amorphous state. To overcome this difficulty, blending of explosives and/or addition of polymeric additives is employed. This is achieved by spray drying a solution containing the desired materials including the secondary high explosive and the polymeric additive, to rapidly precipitate the desired amorphous form.

Rapid precipitation from solution is achieved using conventional spray drying technology. During the spray drying, the feed solution is atomized into fine droplets within a flowing drying gas (usually hot nitrogen or air). Due to the high surface area of the liquid droplets, rapid evaporation can be attained. This consequently leads to rapid precipitation of the solutes within the droplets. It has been shown that the highest precipitation rate occurs at the outer surface. As precipitation progresses, a shell-like structure forms, containing the remainder of the solution within. As the shell thickens, droplet evaporation slows due to impeded mass transfer caused by the shell. As the evaporation rate decreases so does the precipitation rate. Since at slower precipitation rates, formation of crystals becomes increasingly likely, it is important to set the spray drying conditions such as the solution droplet size and heating gas temperature so that no crystalline product is formed.

Selection of the atomizer setting and thereby the droplet size of the atomized solution, will determine the final size of the amorphous particles. This is an important consideration when control over microstructure is necessary, for example the void size distribution in a pressed charge made from the amorphous powder. Particle size will also influence the specific surface area which has a strong effect on the propagation of combustion and detonation of the final amorphous secondary explosive being created.

Further, a critical result of this inventive process is the stabilization of the amorphous explosive—as, as stated above, the subject amorphous materials typically tend to readily convert to the more thermodynamically favorable crystalline state. The desired stabilization is achieved by the addition of polymers. The degree of stability is tied to the amount of the additive, as well as its chemical structure and molecular weight. Modification of these variables enables tuning the product stability to desired levels. Stabilization of the amorphous material is also enhanced by compaction of amorphous powder to form pellets or any other compressed configuration. Maximum stability is achieved with such pellets or other form at densities near the TMD value of the given material.

The drying gas temperature and flow rate during spray drying should be selected such that the solution droplets are completely dried within the drying chamber. The temperature should not exceed temperatures at which decomposition of the product may take place. Typically, a temperature at or above the boiling point temperature of the solvent is used.

The dry powder can be effectively separated from the drying gas stream using a cyclone separator, however, alternatively a bag filtration may be employed.

Example 1. Preparation of Amorphous CL-20/HMX/PVAc Compositions

Amorphous embodiments of the present invention were prepared using a combination of crystalline secondary explosive materials CL-20 and HMX. Initially the respective secondary crystalline explosive materials were placed into solution with the solvent acetone. The solutions were prepared at room temperature with the following alternative crystalline secondary high explosives and polymer ratios: CL-20/HMX/polymer ratios: 50/45/5 and 60/35/5 wt %, with the solvent to HMX weight ratio fixed at 50/1. The preferred polymer added to the mixture/solution was polyvinyl acetate (PVAc) with a 100,000 M.W. The solutions, with the added PVAc, were spray dried using a Buchi model B-290 laboratory spray dryer equipped with a two-fluid gas nozzle (0.7 mm diameter). $N_2$ was used for atomization as well as the drying gas. The drying gas inlet temperature was set to 90° C. The drying gas flow rate was set to ~35 $m^3$/hour. The liquid feed rate was set to 5 ml/min. The product was collected from the gas stream using a cyclone separator.

The products from Example 1 were analyzed using Powder X-ray Diffraction (P-XRD), and the X-ray diffraction patterns showed a broad diffraction halo without sharp peaks. Therefore, it can be concluded that the materials are highly amorphous. Further, SEM images were taken of the CL-20/HMX/PVAc (60/35/5) product—after the spray drying. The image shows spherical particles with a very small mean size and having smooth surfaces—consistent with amorphous structure.

Example 2. Preparation of Amorphous CL-20/NC

A solution was prepared containing the secondary explosive material CL-20 and the polymeric additive nitrocellulose (NC) (70/30 wt %), with acetone as the solvent. The ratio of CL-20 to acetone was 1/10. The spray drying conditions were the same as described in Example 1. After spray drying to remove the acetone and rapidly precipitate the explosive materials—PXRD analysis on the produced material was done and it was concluded, from the lack of sharp Bragg peaks, that the produced material has an amorphous structure.

Stability Analysis

As detailed above, a critical element of the stabilization of the inventive amorphous powder is use of a stabilizing polymeric additive. For example, when the amorphous composition of the present invention was prepared with polyvinyl acetate (100,000 M.W.), CL-20/HMX/PVAc (60/35/5), the as prepared powder when kept in an oven at 100 C for 16 hours completely converted to a crystalline material as was confirmed by P-XRD analysis. The use of NC as the polymeric additive appears to greatly stabilize the amorphous phase. For example, the amorphous composition prepared with CL-20/NC (70/30) when heated at 100° C. for 16 hours did not show signs of crystallization when inspected by P-XRD.

A second mode of stabilization of the amorphous phase, as disclosed above, is via compaction. The CL-20/HMX/PVAC (60/35/5) composition when pressed into a cylindrical pellet or other configuration, at a density of 1.65 g/cc exhibited greatly improved thermal stability in comparison to the lose powder of the same material. No conversion of the amorphous material to crystalline was observed following exposure to 100° C. for 16 h.

While the present invention was described using certain exemplary, specific embodiments, those skilled in the art will recognize that the teachings presented herein are not limited to these specific embodiments. The preferred embodiments of the invention are provided for the purpose of explaining the principles of the present invention and its practical applications, thereby enabling others skilled in the art to understand the invention. Various embodiments and modifications are contemplated within the scope of the present invention.

What is claimed is:

1. A method of manufacture of amorphous explosives comprising, dissolving at least one crystalline secondary high explosive material with a stabilizing polymer, in an organic solvent to obtain a solution, and spray drying the solution to obtain an amorphous explosive material wherein said amorphous explosive material consists of the amorphous high explosive material dispersed with the stabilizing polymer at the molecular level.

2. The method of claim 1, wherein the crystalline secondary high explosive material is selected from the group consisting of cyclotetramethylene-tetranitramine (HMX), hexanitrohexaazaisowurtzitane (CL-20), and trimethylenetrinitramine (RDX).

3. The method of claim 1, wherein the stabilizing polymer is selected from the group consisting polyvinyl acetate (PVAc) and nitrocellulose (NC).

4. The method of claim 1, wherein the amorphous explosive material is further compacted.

5. The method of claim 1, wherein the organic solvent is acetone.

* * * * *